United States Patent [19]

Sauter

[11] Patent Number: 4,721,554

[45] Date of Patent: Jan. 26, 1988

[54] ELECTROPLATING APPARATUS

[75] Inventor: Erwin A. Sauter, Neulingen-Göbrichen, Fed. Rep. of Germany

[73] Assignee: Inovan-Stroebe GmbH & Co. KG., Birkenfeld, Fed. Rep. of Germany

[21] Appl. No.: 926,818

[22] Filed: Oct. 31, 1986

Related U.S. Application Data

[63] Continuation of Ser. No. 792,308, Oct. 28, 1985, abandoned.

[30] Foreign Application Priority Data

Oct. 31, 1984 [DE] Fed. Rep. of Germany ..... 3439750

[51] Int. Cl.[4] ..... C25D 7/06; C25D 17/10

[52] U.S. Cl. ..... 204/206; 204/224 R

[58] Field of Search ..... 204/206, 211, 224 R, 204/207, 208, 209, 210

[56] References Cited

U.S. PATENT DOCUMENTS

| | | | |
|---|---|---|---|
| 2,370,973 | 3/1945 | Tang | 204/DIG. 2 |
| 3,522,166 | 7/1970 | Jones | 204/206 |
| 3,644,181 | 2/1972 | Donaldson | 204/28 |
| 3,650,935 | 3/1972 | Andersson | 204/28 |
| 3,865,701 | 2/1975 | Borgmann | 204/28 |
| 4,014,773 | 3/1977 | Furuya | 204/206 |
| 4,304,653 | 12/1981 | Winand | 204/206 |
| 4,347,115 | 8/1982 | Espenhahn et al. | 204/206 |
| 4,378,284 | 3/1983 | Iwasaki et al. | 204/206 |
| 4,434,040 | 2/1984 | Brendlinger | 204/206 |
| 4,505,785 | 3/1985 | Miwa et al. | 204/28 |

*Primary Examiner*—John F. Niebling
*Assistant Examiner*—William T. Leader

[57] ABSTRACT

In a method for high-speed electrolytic-deposition of metallic layers on ribbon or cord-like strips, the strips which are electrically connected to the negative side of an electric DC power source are moved through a hollow guide rail containing an electrolyte solution and past an anode structure arranged within the hollow guide rail and connected to the positive side of the DC power source. An electrolyte solution circulating conduit structure including a circulating pump is connected to opposite ends of the guide rail and, while the metal is deposited on the strip which is moved through the guide rail in one direction, the electrolyte solution is circulated through the guide rail in the opposite direction at a speed which provides for a Reynolds No. of over 80,000 with regard to the relative strip speed in the electrolyte solution so as to provide turbulent flow conditions adjacent the strip surface which greatly increase the electrolyte deposition rates.

The hollow guide rail is preferably arranged vertically with the strip moving upwardly and the electrolyte solution flowing downwardly through the guide rail.

4 Claims, 3 Drawing Figures

ELECTROPLATING APPARATUS

This application is a continuation of application Ser. No. 792,308, filed 10-28-85, now abandoned.

BACKGROUND OF THE INVENTION

The invention relates to a method of plating ribbon or cord-type structures with a metal coating by continuously moving the ribbon or cord structure which is negatively charges through a trough containing an electrolyte past a positively charges electrode disposed in the trough and to an apparatus for performing the method.

For the electroplating of surfaces of wires, ribbons, stamped grid straps, cords or other ribbon-type structures, such ribbon-type structures are passed continuously through a trough which contains an electrolyte solution (or a salt melt). The ribbon-type material, simply called ribbon from hereon, which is to be plated forms the cathode on which the metals dissolved in the electrolyte are deposited by ion migration. As a result of such ion migration however the electrolyte becomes depleted of ions in the area of the ribbon cathode so that it becomes important to constantly add fresh electrolyte for replenishing the ions. In most known electroplating processes of the type under consideration the ribbon is exposed to new ions by moving the ribbon through the electrolyte solution so that it is constantly in contact with fresh electrolyte solution. In modern plants the electrolyte is additionally constantly circulated and renewed is moved, at least in the trough through which the ribbon is moved, the electrolyte always contains sufficient metal ions. This however, does not insure that there are sufficient metal ions in direct vicinity of the ribbon that is in the vicinity of the surfaces to be plated. However, only if sufficient ions (or rather anions) for the electron-transport are available, a relatively large amount of metal can be deposited on the cathode, and only then can the process be performed efficiently with high current flow density. Obviously, the better the exchange of electrolyte next to the surface of the ribbon to be plated, the higher the speed of metal deposition and the higher the current utilization that is, the faster is the metal deposited on the ribbon in the desired fashion whereby, at the same time, the operating efficiency of the electroplating equipment is improved.

In order to obviate the ion depletion in the area of the surfaces to be plated the electrolyte solution has been continuously replenished and has been kept in motion within the trough as already mentioned. These measures were intended to insure the presence of sufficient depositable metal ions in the vicinity of the material surfaces to be plated.

State of the art plants which utilize such methods have already acheived high depositing velocities. However it is the object of the present invention to increase the speed of plating ribbon type structure even further.

SUMMARY OF THE INVENTION

Very high metal deposition speeds are acheived in a high-speed electrolytic metal deposition process in which a ribbon or cord-like strip is metal plated while being moved through a hollow guide rail containing an electrolytic solution. The strip is electrically connected to the negative side of DC power source and an anode structure disposed in the hollow guide rail adjacent the path of movement of the strip is connected to the positive side of the DC power source. The opposite ends of the hollow guide rail are connected to circulating conduit means including a pump for circulating the electrolyte solution through the hollow guide rail in one direction while the strip is moved through the hollow guide rail in the opposite direction such that a high relative speed of the strip in the electrolyte solution is obtained at which the flow at the strip surface is in the turbulent range.

The invention is based on the consideration that a high changeover of electrolyte solution at the surface of a ribbon to be plated is obtained with a high relative speed of the ribbon to be plated in the electrolyte solution. The highest relative speed can be obtained if the ribbon movement and the electrolyte moment are exactly in opposite directions. Then it is guaranteed that, before a depletion of the electrolyte in the vicinity of the ribbon could occur, already fresh electrolyte liquid is present so that an uninterrupted flow of metal ions to the ribbon cathode is always insured.

It has to be added however that these considerations, although theoretically conclusive are not always correct in practice. These considerations are particularly then misleading when the electrolyte liquid stream is laminar. In accordance with the invention the relative speed of the ribbon in the electrolyte liquid and, furthermore, the relative speed in the boundary layer of the material to be deposited must be in the turbulent range. This generally requires that, at a ribbon speed of at least 0.1 m/sec, the speed of the oppositely directed electrolyte flow is to be above 1 m/sec such that the Reynolds Number is above 80,000. The Reynolds number is a measure for the kind of flow present that is it indicates whether the flow is laminar or turbulent. In the present case the relative speed of the ribbon in the flowing liquid electrolyte is the determining factor. It is not only important that sufficient fresh electrolyte solution is present in the trough containing the solution it is even more important that the fresh electrolyte solution with a large number of depositable metal ions is present in close vicinity of the ribbon to be plated. Since in accordance with the present invention the electrolyte solution flows exactly counter to the direction of movement of the ribbon to be plated the highest possible relative speed of the ribbon in the electrolyte solution is obtained. Depletion of the solution along the ribbon surface is avoided if the flow along the ribbon surface is generally turbulent so that the metal ions are not only brought out of the solution into the vicinity of the ribbon surface but also electron migration to the caathode that is the ribbon surface, is enhanced by the turbulence along the surface. It should be pointed out in this connection that the boundary layer under turbulent flow conditions is by far, that is by orders of magnitude, thinner then under laminar flow conditions, that is that the high relative speed of the ribbon and the turbulence acheived therewith together with thin boundary layers are the main reason for the high depositing or plating velocity of the process according to the invention. It has been determined empirically that turbulent flow is present already at Reynolds numbers of more than 2,320. At a Reynolds number of 80,000 as it is considered to be desirable in connection with the present invention it is certain that the electrolyte solution flow is turbulent.

For the performing of the method according to the invention an apparatus is provided with a hollow guide rail of insulating material with end openings having a cross-section corresponding about to the cross section of the ribbon to be plated. Anodes are connected to the guide rail and a circulating pipe structure including a circulating pump is connected to opposite ends of the guide rail. The circulating pipe structure may also include a storage container for the electrolyte liquid such that fresh liquid electrolyte may continuously be added to the storage container so as to maintain it at a predetermined desired value. The length of the guide rail is selected so as to provide for the desired plating thickness. At constant ribbon, and electrolyte flow speeds and constant current densities the plating thickness is proportional to the length of the hollow guide rail. The proportionality factor however is dependent on the materials utilized: For the deposition of palladium for example the hollow guide rail, under otherwise identical conditions, would have to be ten times as long as it would be necessary for a silver plating process.

The anodes may fully cover the inner surfaces of the hollow guide rail or they may be disposed on only part thereof. They may be provided for example only on one side of the guide rail if it is desired to plate perferably only one side of the ribbon. In this case it is advantageous if the other side of the ribbon is masked either by a cover mounted on the guide rail or by a cover ribbon moving with the ribbon to be plated. The anodes may also be provided in the form of strips extending lengthwise along the inner walls of the guide rail if it is desired to deposit plating stripes. However also if the surface of the ribbon is to be fully plated it may be advantageous to provide the anode surface in the form of stripes which should then be divided in longitudinal direction and displaced relative to one another. It is also possible to arrange the anodes on the inner surfaces of the hollow guide rail lengthwise evenly spaced one after the other and to provide a ribbon drive adapted to move the ribbon stepwise a distance corresponding to the spacing of the electrodes. In this manner it would be possible to generate plating strips or spots on the ribbon surface spaced from one another widthwise and lengthwise as desired.

Preferably the anodes are so mounted on the inner surfaces of the guide rail that their distance from the ribbon surface is adjustable by supporting the anodes on bolts which are adjustable in a direction normal to the extension of the hollow guide rail that is the ribbon. This permits to control the plating rate by adjustment of the electron migration resistance and it also permits to some extent adjustment of the plating area dimensions.

It has already been said that it may be advantageous to provide, within the guide rail, a masking ribbon which moves with, and partially covers, the ribbon to be plated. If only selective plating is desired it is of course possible to form the masking ribbon accordingly such that only selected areas are exposed.

With regard to the arrangement of the hollow guide rail it is noted that tests have shown that it is advantageous to mount the guide rail in an upright position and to move the ribbon material through the guide rail from the bottom to the top and conduct the liquid electrolyte through the guide rail from the top to the bottom thereof.

SHORT DESCRIPTION OF THE DRAWING

Figure 1:
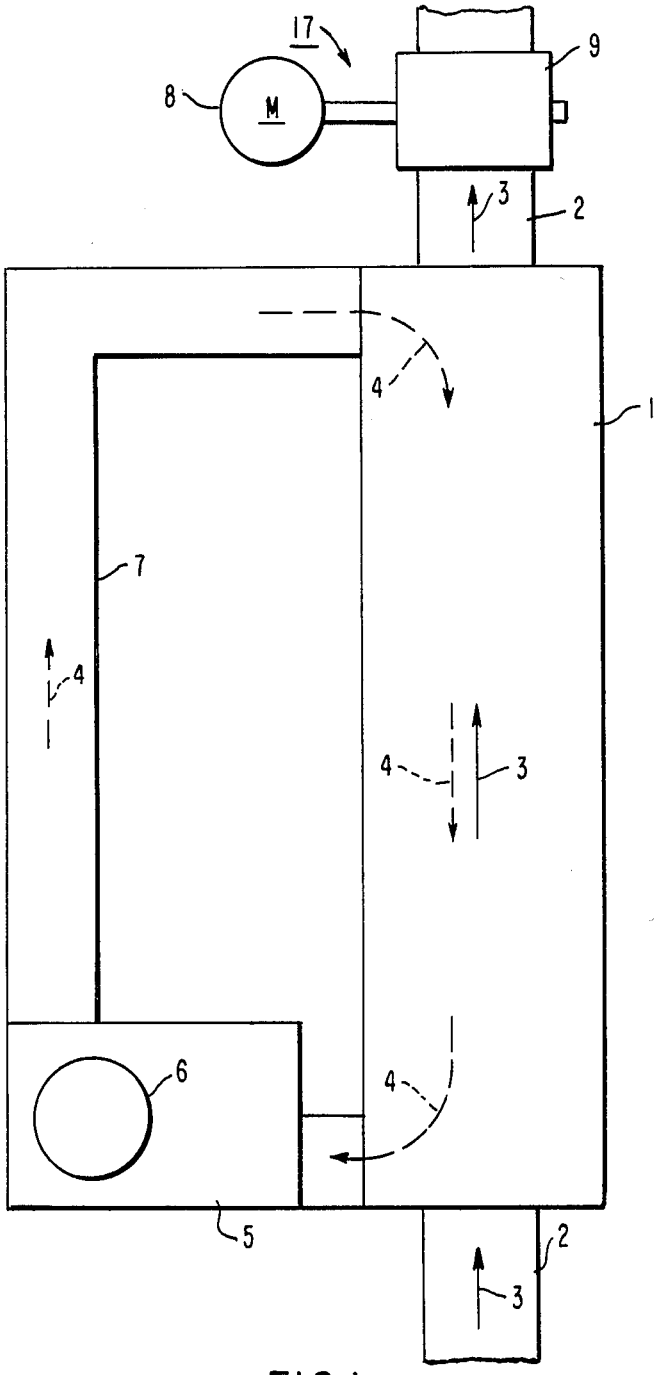
FIG. 1 shows schematically the apparatus according to the invention.

As shown in FIG. 1 there is provided an upright hollow guide rail 1 which has an inner passage with a cross-section corresponding to the cross-section of the ribbon 2 to be plated which ribbon is being moved upwardly through the hollow guide rail 1 by advancing means 7 as indicated by arrows 3. Exactly in a direction opposite to the direction of movement of the ribbon 2, that is downwardly, the liquid electrolyte is conducted through the hollow guide rail 1 as indicated by arrow 4. The liquid electrolyte is circulated from a container 5 by way of circulating pump 6 through a circuit pipe 7 which is connected to opposite ends of the hollow guide rail 1.

The advancing means 7 comprise a drive motor 8 and friction rollars 9 driven by the motor 8.

Figure 2:
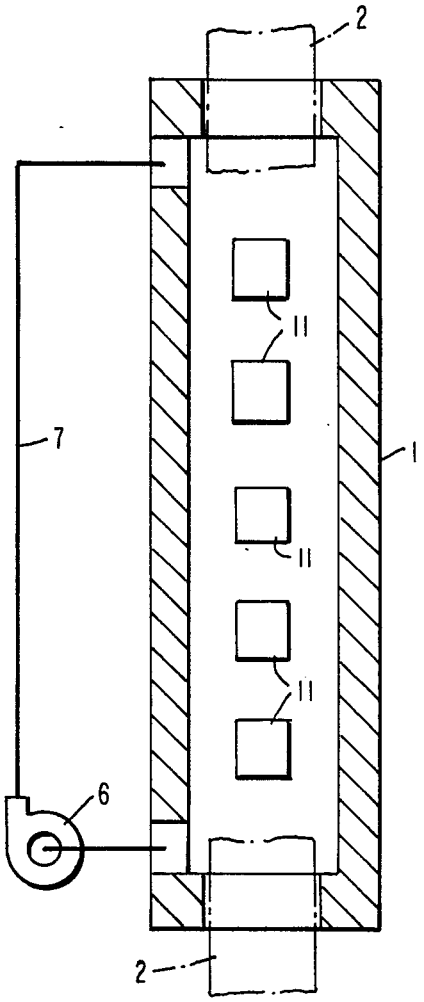
FIG. 2 shows an electrode structure in the hollow guide rail.
Figure 3:
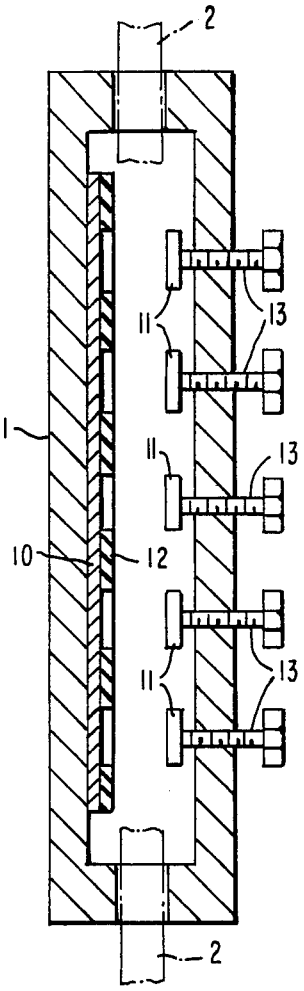
FIG. 3 shows adjustment means and a mask structure within the hollow guide rail.

As shown in FIGS. 2 and 3 the hollow guide rail 1 may have anode structures 10 and 11 disposed on its inner surface. The anode structure 10 fully covers one side of the inner surface of the guide rail however the ribbon surface may be partially covered by a mask 12. The anode structure 11 consists of a strip divided lengthwise into sections which are supported for example on bolts 13 so as to permit adjustment of the spacing of the anode structure 11 relative to the surface of the strip 2. Different sections of the anode structure may be connected to different power supply circuits.

If the operating conditions mentioned earlier are maintained that is if the ribbon 2 is moved through the guide rail 1 at a speed of more than 0.1 m/sec and the liquid electrolyte speed in the guide rail is at least 1 m/sec substantially increased plating speeds are indeed acheived. Tests have shown that metal depositing speeds of up to ten times those available with prior art processes can be achieved at an electrolyte efficiency of between 97% and 100%.

I claim:

1. An apparatus for electrolytically depositing metallic layers on an elongated ribbon-like strip, said apparatus comprising a hollow guide rail having a free interior cross-section so as to be adapted to receive and closely surround said strip, said hollow guide rail forming a container for receiving an electrolyte solution containing metal ions to be deposited on said strip, an anode sstructure affixed to an inner surface of said hollow guide rail, a circulating conduit structure connected to opposite ends of said hollow guide rail, and a circulating pump arranged in said circulating conduit structure for circulating said electrolyte solution through said guide rail along the surfaces of a section of the strip extending through said guide rail, said anode structure comprising sections projecting toward said strip so as to be disposed in closely spaced relationship to the surface of said strip so as to form a patterned metallic layer deposit on said strip, each section being independently adjustably supported within said hollow guide rail so as to permit independent adjustment of the spacing of said anode structure sections from the strip surface, said sections being associated with different power supply circuits.

2. An apparatus according to claim 1, wherein said anode structure consists of sections arranged in strip-movement direction along the inner hollow guide rail surface at equally spaced locations and wherein means are provided for the advancing of said strip in steps corresponding to the spacing of said locations.

3. An apparatus according to claim 1, wherein a mask structure is disposed in said hollow guide rail adjacent a surface of said strip so as to cover portions of the surface of said strip.

4. An apparatus according claim 1, wherein said hollow guide rail is arranged in a vertical orientation.

* * * * *